US005395274A

United States Patent [19]

Myers

[11] Patent Number: 5,395,274

[45] Date of Patent: Mar. 7, 1995

[54] REMOTE CONTROL BUBBLE DISPENSING VEHICLE

[76] Inventor: Jeff D. Myers, 7525 N. Shadow Mountain Rd., Paradise Valley, Ariz. 85253

[21] Appl. No.: 224,144

[22] Filed: Apr. 7, 1994

[51] Int. Cl.[6] ..... A63H 33/28; A63H 30/00

[52] U.S. Cl. ..... 446/16; 446/176; 446/454

[58] Field of Search ..... 446/15, 16, 18, 20, 446/21, 454, 455, 456

[56] References Cited

U.S. PATENT DOCUMENTS

| | | | |
|---|---|---|---|
| 2,249,608 | 7/1941 | Greene | 446/15 |
| 2,675,641 | 4/1954 | Baggott | 446/18 |
| 3,913,260 | 10/1975 | Corbett | 446/16 |
| 4,016,673 | 4/1977 | Constance | 446/18 |
| 4,367,608 | 1/1983 | Melotti | 446/20 |
| 4,563,162 | 1/1986 | Ishimoto | 446/454 |
| 4,563,626 | 1/1986 | Ohtake | 446/454 |
| 4,576,582 | 3/1986 | Panzarella | 446/18 |

FOREIGN PATENT DOCUMENTS

| | | | |
|---|---|---|---|
| 2186199 | 8/1987 | United Kingdom | 446/15 |

*Primary Examiner*—Robert A. Hafer
*Assistant Examiner*—Jeffrey D. Carlson
*Attorney, Agent, or Firm*—Warren F. B. Lindsley

[57] ABSTRACT

Apparatus for generating a stream or burst of air through a vehicle mounted bubble dispensing nozzle and controlled by a remote transmitter which generates signals for receipt by a receiver mounted on the vehicle for controlling the generation of the bubbles and movement of the vehicle is disclosed.

10 Claims, 2 Drawing Sheets

REMOTE CONTROL BUBBLE DISPENSING VEHICLE

BACKGROUND OF THE INVENTION

This invention relates to toys and more particularly to model toys such as, inter alia, sophisticated radio controlled electric motor actuated bubble dispensing cars and trucks and other types of vehicles.

Toys from the earliest days have been a necessary constituent of human health and development. Competition has produced countless ingenious contrivances which are models of cars, tanks, airplanes and the like and many remotely controlled by radio transmitter receiver equipment for movement and equipment functions.

DESCRIPTION OF THE PRIOR ART

Many toys are model machines of known equipment and particularly objects such as cars, trucks and various military vehicles. Some of the military vehicles have been known to dispense projectiles but no vehicle is known which selectively dispenses from a self contained liquid mixture a stream of bubbles.

SUMMARY OF THE INVENTION

This invention relates to liquid dispensing model vehicles which may be radio controlled.

It is, therefore, one object of this invention to provide a new and improved model vehicle that selectively dispenses a stream of bubbles.

Another object of this invention is to provide a new and improved remotely controlled motor driven vehicle that selectively dispenses a stream or burst of bubbles.

A still further object of this invention is to provide a model machine such as a self powered automobile that contains its own water supply and pressurizing means which may be programmed to selectively dispense a stream or burst of bubbles.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
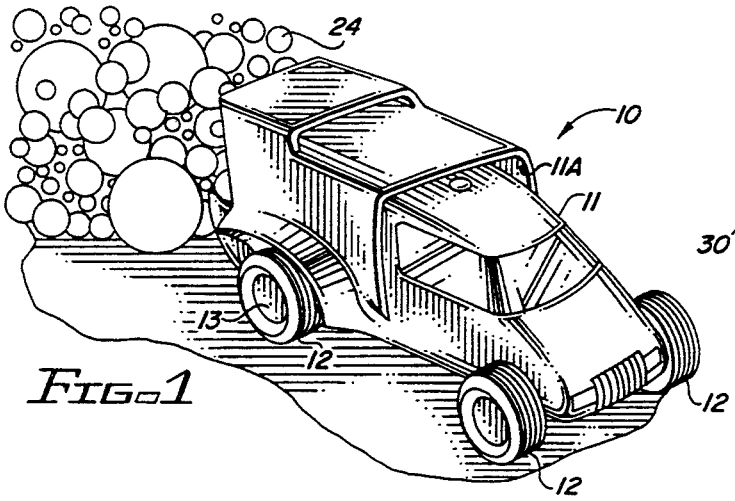
FIG. 1 is a perspective view of a model automobile containing a self contained water supply for dispensing bubbles and embodying the invention.
Figure 2:
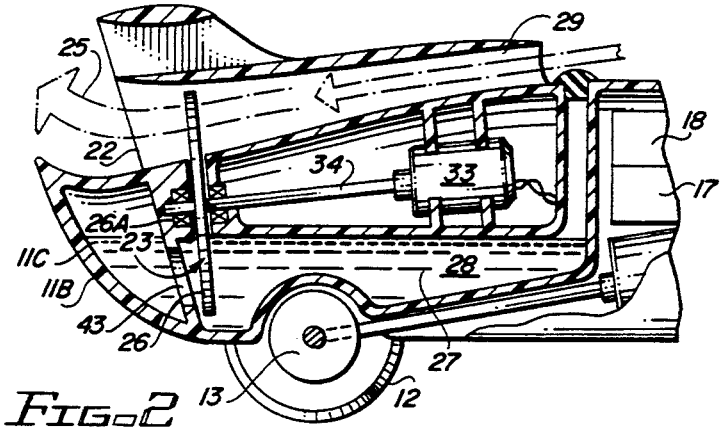
FIG. 2 is a cross sectional view of FIG. 1.
Figure 3:
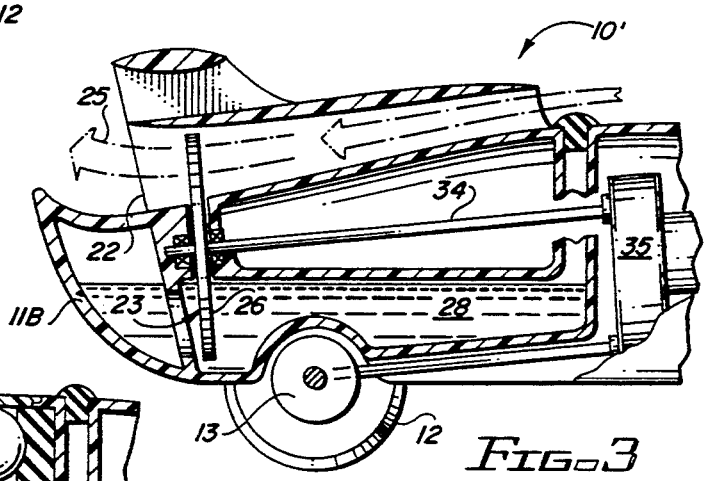
FIG. 3 is a cross sectional view of a modification of the mechanism shown in FIG. 1.

Referring more particularly to the drawings by characters of reference, FIGS. 1–3 disclose a vehicle 10 comprising an automobile like body 11 with the back pair of wheels 12 driving the vehicle and the front pair of wheels steering the vehicle. It should be noted that the term vehicle is intended to mean all forms of model cars, trucks, boats, aircraft and the like.

Figure 4:
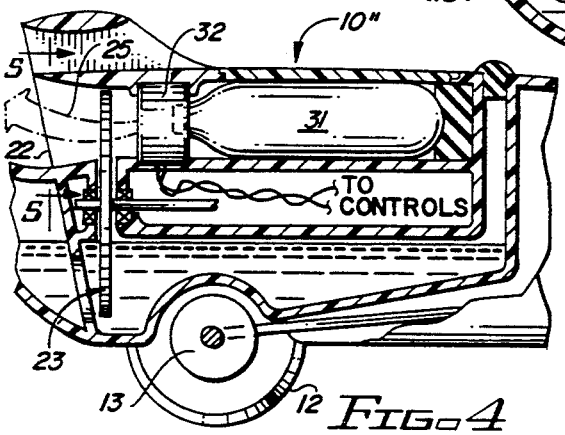
FIG. 4 is a diagrammatic illustration of a modification of FIGS. 1 and 3 illustrating a self contained pressurized source of air under pressure and a valve control for dispensing a burst or stream of air under pressure for generating bubbles.
Figure 5:
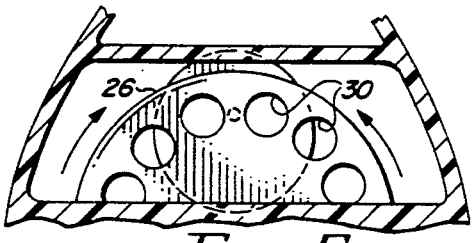
FIG. 5 is a cross sectional view of FIG. 4 taken along the line 5—5.

Vehicle 10 is driven by one or a pair of twin motors 13 which may be a Mabuchi product with one motor connected to each of the front and back wheels of the vehicle for independent or joint rotation thereof in either direction of rotation. As shown in FIGS. 2, 3 and 4 motors 13 are connected to the axle 50 of the wheels 12 for controlled rotation thereof.

Figure 10:
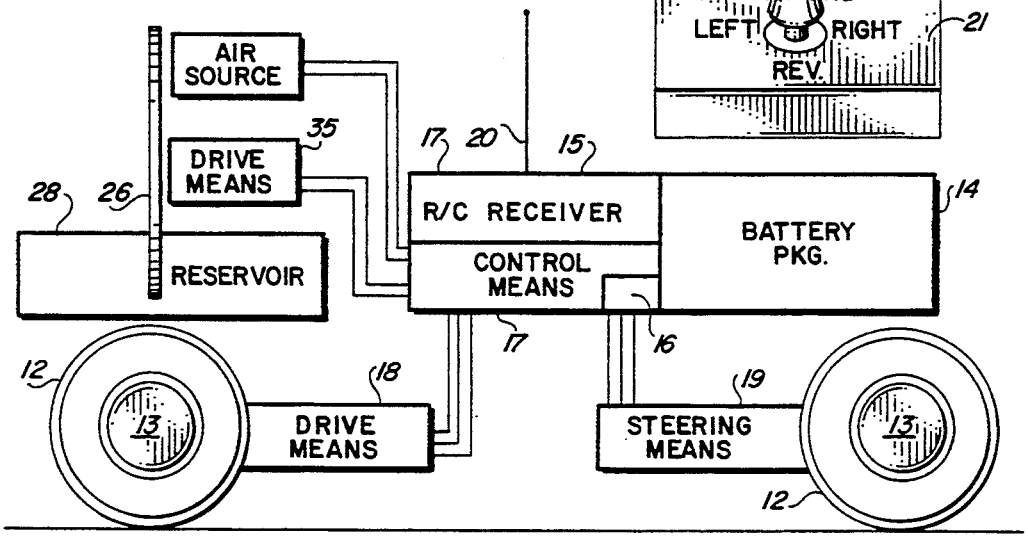
FIG. 10 is a diagrammatic illustration of the means used for remote control of the vehicles shown in FIGS. 1, 4, 8 and 9.

Motors 13 are interconnected to a battery pack 14 shown in FIG. 10, through a radio controlled receiver 15. The battery pack may be a rechargeable 9.6 volt NiCd Tyco Industries, Inc.'s of Moorestown, N.J. product or 7.2 or other multi battery configuration of various voltages from the same or different companies. An on-off switch 16 forming a part control means 17 for the radio controlled receiver 15 may be used for controlling the energization of motors 13 through drive means 18 and steering means 19, such as a pair of steering wheels. An antenna 20 also forming a part of the radio controlled receiver 15 is utilized for receiving signals from a suitable transmitter 21 diagrammatically shown in FIG. 11 but well known in the art.

The transmitter comprises a number of controls the adjustment of which manipulates the various parts of the vehicle during operation. Although transmitters may vary between different manufacturers and even between different models of the same manufacturer, all have some similar controls for operating toy vehicles.

Figure 11:
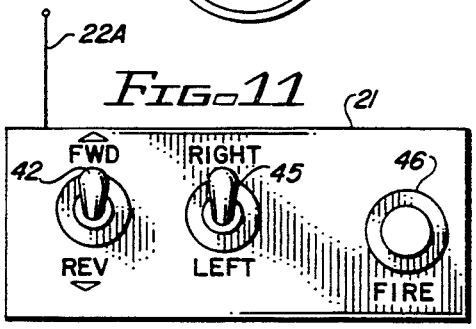
FIG. 11 illustrates the remote control panel for operation of the vehicles shown in FIGS. 1, 4, 8 and 9.

As shown in FIG. 11, transmitter 21 provides drive wheel control for vehicle 10 to direct its movement pattern and also as hereinafter explained the control of a bubble dispensing opening or nozzle 22 mounted thereon. An antenna 22A is suitably mounted on the outside of the housing of transmitter 21 for broadcasting control signals to the receiver 15 of the model vehicle 10 in a well known manner.

The primary job of the operator is to control and maneuver the vehicle, i.e., to direct its movement pattern. The direction and speed of the vehicle is determined by the surface on which it travels.

Figure 12:
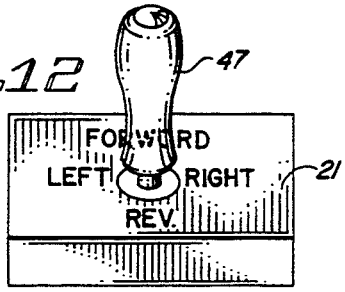
FIG. 12 illustrates a modification of the transmitter shown in FIG. 11 wherein a single switch is used for controlling the movement of the vehicle and its bubble generating means.

As shown in FIG. 12, a single switch such as the known Joy sticks for use in controlling the flight of model airplanes may be used for controlling the vehicles disclosed herein.

In accordance with the invention claimed, a bubble generating mechanism 23 is mounted on the remotely controlled vehicle 10 and is operable to remotely control the dispensing of a burst or steady stream of bubbles 24.

This stream or burst of bubbles is generated by a burst or stream of air diagrammatically illustrated by arrows 25 forced through a pipe line or channel 29 by the movement of the vehicle or by another suitable source of air or gas under pressure.

As shown in FIGS. 1–4, the vehicles illustrated may each employ a scoop 11A formed around the sides and top of the vehicle which channels the air entering the scoop into a nozzle like entranceway to channel 29. Further, the back 11B of the vehicle may be formed or contoured to direct the air leaving channel 29 in an upward direction.

Figure 7:
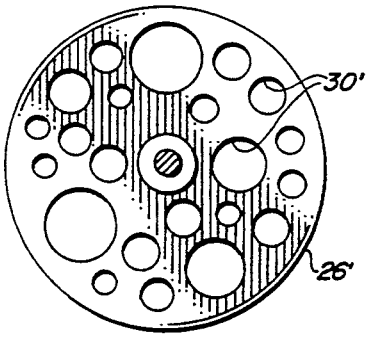
FIG. 7 is a modification of the disk shown in FIG. 6 showing various sized openings therethrough.

As shown in FIG. 2, an apertured disk 26 is mounted to rotate in a reservoir 27 of a suitable liquid, i.e. soap solution, 28 for generating bubbles. The rotating disk 26 picks up over its surface and across its apertures a liquid film from the reservoir and moves it into the stream or bursts of air moving or driven through longitudinally channel 29 and its nozzle 22 as shown in FIG. 2. The air passing or forced through apertures 30 of disk 26 and against the film of liquid formed therein generates bubbles 24 in the usual manner directed upwardly so the rear of the vehicle. FIG. 7 illustrates that the apertures 30' of disk 26' may vary in size.

Thus, when an operator transmits a given signal from transmitter 21 to vehicle 10 by its switch 46 identified as FIRE in FIG. 11, a D.C. motor 33 mounted in vehicle 10 is energized causing its rotor 34 to rotate and the axially mounted disk 26. Since disk 26 is journalled to extend at least partially into reservoir 27 it receives a soapy coating as it dips into and rotates in reservoir 27.

In order to avoid a sudden surge of liquid 28 from reservoir 27 through the bearing 26A of disk 26 during initial movement of the vehicle and into channel 29, an opening or port 43 is provided in the back portion of body 11 of the vehicle as shown in FIG. 2. This port provides a supplementary reservoir 11C within back 11B of the vehicle for reception of liquid from reservoir 27 during sudden movement of the vehicle.

The dual purpose transmitter 21 controls the functions of driving the vehicle in a controlled pattern through the energization of motors 13 on the rear and front wheels of the vehicle and selectively generates a stream or burst of bubbles through the apertures of disk 26. More than one transmitter may be used if so desired. Different channels or frequencies of a transmitter can be used to control the bubble generating mechanism 23 as well as functions of the vehicle.

As shown in FIGS. 1 and 2, the movement of the vehicle generates a flow of atmospheric air through channel 29, apertures 30 of disk 26 and through nozzle 22 to atmosphere thereby generating bubbles 24.

FIG. 3 discloses a modification of the vehicle shown in FIGS. 1 and 2 wherein motors 13 of the rear wheels 12 of vehicle 10' are energized and driven by the same control means 17 that drives the apertured disk 26.

FIG. 4 discloses a further modification of vehicle 10 wherein vehicle 10'' is provided with a contained cylinder 31 of a suitable gas such as compressed air or carbon dioxide and a suitable valve 32 which is controlled by control means 17 and receiver 15 for selectively discharging the gas through apertures in disk 26.

Figure 6:
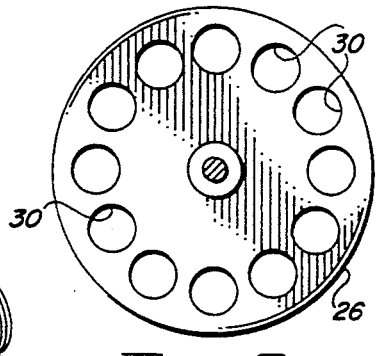
FIG. 6 is a plan view of the rotating disk shown in FIGS. 1–4.

FIGS. 6 and 7 disclose disks 26, 26' with disk 26 having similar apertures 30 arranged in a circle around the disk and disk 26' having a variety of different size apertures 30' randomly spaced through disk 26'.

Figure 8:
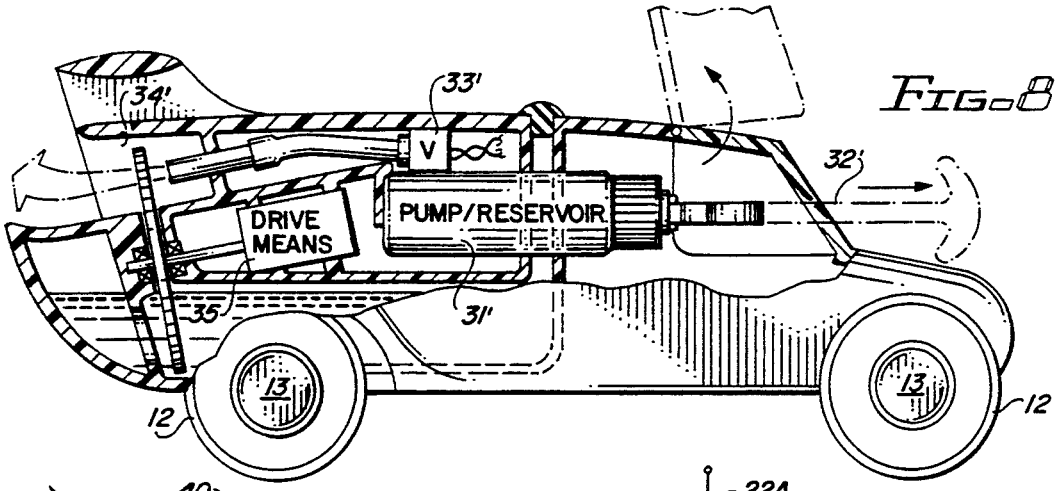
FIG. 8 is a modification of the bubble dispensing vehicle shown in FIG. 1 employing a self actuated pump/reservoir arrangement for selectively dispensing a burst or stream of bubbles.

FIG. 8 discloses a modification of the vehicle structure shown in FIGS. 1 and 2 wherein a reservoir or cylinder 31' may contain a hand actuated pump 32' built therein which is pressurized by a piston, not shown. A valve 33' interconnecting cylinder 31' with pipeline 34' is radio controlled by a signal received from transmitter 21 which energizes an actuator for selectively opening and Closing valve 33' in a known manner.

It should be noted that the air dispensing control means shown in FIG. 8 may be mounted on any type of vehicle and still fall within the scope of this invention.

Figure 9:
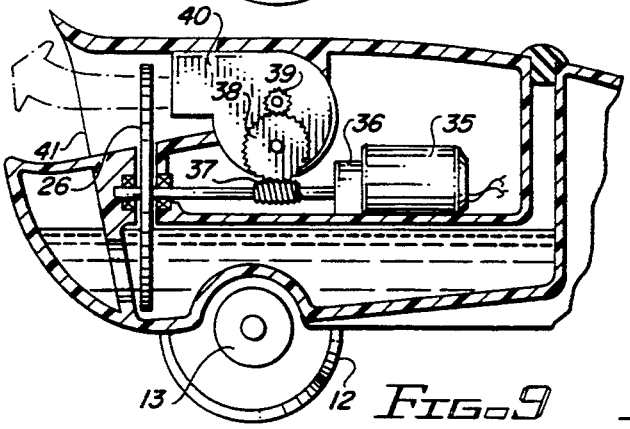
FIG. 9 is a further modification of the pressure generating means shown in FIG. 4 for dispensing a burst or stream of bubbles.

FIG. 9 illustrates a further bubble generating means comprising an electric motor 35 which drives through gear box 36 a worm gear 37 and a train of gears 38 and 39 connected to a drum mounted blower 40 which directs air through disk 26 and through nozzle 41 to atmosphere.

FIG. 10 illustrates in block diagram the controls for the vehicles and dispersal of the bubbles.

FIGS. 11 and 12 illustrate the hand controls or switches for operating the vehicle and its bubble generating means.

The transmitter 21 shown in FIG. 11 discloses a toggle switch 42 that Controls the energization of the drive motors of the vehicles such as the vehicles shown in FIGS. 1–4 and 9 that causes forward and reverse operation of the vehicle while toggle switch 45 results in the left or right movement of the vehicle in a well known manner. Switch 46 energizes the bubble generating means disclosed.

FIG. 12 discloses a switch 47 comprising a joy switch type that controls the functions of vehicle movement and bubble generation.

Although but a few embodiments of the invention have been illustrated and described, it will be apparent to those skilled in the art that various changes and modifications may be made therein without departing from the spirit of the invention or from the scope of the appended claims.

What is claimed is:

1. A model vehicle for generating a stream or burst of bubbles under control of a remote transmitter transmitting radio signals to a receiver on board the vehicle comprising:

vehicle movement means;

a reservoir in said vehicle comprising a source of liquid;

a bubble dispensing nozzle mounted on said vehicle;

channel means extending longitudinally of said vehicle for directing upon movement of the vehicle a stream of air through said nozzle;

an air scoop facing the front of the vehicle and in communication with the channel means and the nozzle;

an apertured disk journalled for rotation on the vehicle and positioned to extend at least partially into said source of liquid and upstream of said nozzle;

a transmitter for transmitting radio signals to said vehicle;

a receiver mounted on board said vehicle for receiving a signal from said transmitter; and means mounted on said vehicle and actuated by said signal for rotating said disk and actuating said vehicle movement means to move said vehicle;

whereby movement of said vehicle forces air into the air scoop creating a stream or burst of air which is transmitted through said channel, at least some of the apertures in said disk and said nozzle for generating and discharging a stream of bubbles from said vehicle.

2. The model vehicle set forth in claim 1 wherein:

said vehicle movement means comprises at least a pair of drive wheels and a pair of steering wheels.

3. The model vehicle set forth in claim 1 wherein:

said liquid comprises a soap solution.

4. The model Vehicle set forth in claim 1 wherein:

said disk comprises a plurality of apertures arranged in a circle and extending therethrough.

5. The model vehicle set forth in claim 1 wherein:

said disk comprises a plurality of randomly positioned apertures of various sizes extending therethrough.

6. The model vehicle set forth in claim 1 wherein:

said disk comprises a plurality of similar size apertures extending therethrough.

7. The model vehicle set forth in claim 1 wherein:

the air scoop extends over the top and around at least a part of the sides of said vehicle for funneling air movement into said channel means.

8. The model vehicle set forth in claim 1 wherein:

said vehicle movement means comprises a motor and a battery.

9. A model vehicle for generating a stream or burst of bubbles under control of a remote transmitter transmitting radio signals to a receiver on board the vehicle comprising:

vehicle movement means featuring a drive train and propulsion motor;

an on-board container reservoir comprising a source of liquid;

means for dispensing air under pressure mounted on board said vehicle;

a bubble dispensing nozzle mounted on said vehicle;

pipe means for connecting said nozzle with said dispensing means;

an apertured disk journalled for rotation on the vehicle and positioned to extend at least partially into said source of liquid upstream of said nozzle;

a transmitter for transmitting radio signals to said vehicle;

a receiver mounted on board said vehicle for receiving a first signal from said transmitter;

means mounted on said vehicle and actuated by said first signal for rotating said disk and dispersing a stream or burst of air from said dispensing means through said nozzle to generate a burst or stream of bubbles; and a first control means mounted on board said vehicle for receiving a second signal from said transmitter for controlling movement of said vehicle.

10. The model vehicle set forth in claim 9 wherein:

said means for dispensing air under pressure comprises a hand movable piston for charging a cylinder; and a valve means connected to said cylinder and actuated by said first signal for receiving air under pressure from said cylinder for movement through said nozzle.

* * * * *